United States Patent [19]

Gillen, Jr.

[11] Patent Number: 4,696,605

[45] Date of Patent: Sep. 29, 1987

[54] COMPOSITE REINFORCED CONCRETE AND TIMBER PILE SECTION AND METHOD OF INSTALLATION

[76] Inventor: Gerard J. Gillen, Jr., 4512 Ithaca St., Metairie, La. 70006

[21] Appl. No.: 837,707

[22] Filed: Mar. 7, 1986

[51] Int. Cl.[4] ..... E02D 5/22; E02D 5/52

[52] U.S. Cl. ..... 405/251; 405/232

[58] Field of Search ..... 405/250, 251, 232, 233, 405/252–256; 52/726; 403/306

[56] References Cited

U.S. PATENT DOCUMENTS

| | | | |
|---|---|---|---|
| 1,715,791 | 6/1929 | Sherwood | 405/250 |
| 1,890,268 | 12/1932 | Smith | 405/250 |
| 2,558,529 | 6/1951 | Thornley | 405/250 X |
| 2,912,829 | 11/1959 | Cobi | 405/250 |
| 4,431,347 | 2/1984 | Gillen | 405/251 |

*Primary Examiner*—Dennis L. Taylor

*Attorney, Agent, or Firm*—Pravel, Gambrell, Hewitt, Kimball & Krieger

[57] ABSTRACT

A method of installing a composite pile structure of a timber pile section and a precast reinforced concrete pile section includes a driving of the timber pile section into the earth a distance well below the earth's surface, a distance substantially equal to the length of the reinforced concrete pile section. A hollow, tubular sleeve having a bore is used during driving of the timber pile section to prevent soil from entering the area vertically above the timber pile section. A precast, preset reinforced concrete pile member is placed in the bore of the sleeve. The bottom of the concrete pile carries a connector that is embedded partially in the lower end portion of the concrete pile. The connector joins the bottom of the concrete pile with the top of the timber pile. After joining, the tubular sleeve is removed so that soil encroachment can laterally support the reinforced concrete pile section.

8 Claims, 7 Drawing Figures

COMPOSITE REINFORCED CONCRETE AND TIMBER PILE SECTION AND METHOD OF INSTALLATION

BACKGROUND OF THE INVENTION

The present invention relates to piling and pile driving, and more particularly relates to a composite timber and reinforced concrete pile construction. Even more particularly, the present invention relates to an improved method for installing composite pile constructions which include a lowermost timber pile section and an uppermost reinforced concrete pile section wherein the timber pile section is first driven with a steel punch or mandrel inside an outer sleeve, well below the earth's surface a distance substantially equal to the length of the reinforced pile section. A hollow, tubular sleeve is used to prevent soil from entering the area above the timber pile adjacent the punch or mandrel. The concrete pile is then installed in the bore of the sleeve and joined to the top of the timber pile with a connector that is embedded partially in the lower end of the concrete pile.

In various areas of the country where bearing pressures of soil are low and/or unsuitable for building purposes, construction can employ the use of one or more elongated load carrying elements referred to in the industry as a pile or piling. These devices for transferring load between a building and the underlying earth can be concrete, steel, or timber, in construction.

Timber piling are usually somewhat restricted in length because of the very nature of their source, namely trees. Thus it is desirable to splice piling together to form piling of extended length. These timber piling can also vary in diameter from end to end, complicating the splicing operation. Timber piling above the water line is generally more prone to rotting. Thus, it is desirable to use a concrete pile above the water line when composite piling are used.

Often times timber pile are combined with piling of other construction such as, for example, concrete. U.S. Pat. No. 3,003,323 issued to A. R. Holt provides a "Composite Pile Connector." A "Pile Splicer" is also the subject of U.S. Pat. No. 3,802,206 issued to Robert Moore, et al. In that patent a splicing means for connecting two wood piles end to end to make a long pile for the transfer of pile loads to a lower stronger ground id disclosed. The splicer in that patent provides a plate-like, substantially horizontal element adapted to lie between adjacent pile ends. Optional epoxy glue between the upper and lower surfaces can be provided between the element and the upper and lower piles. A central upright dowel member extends above and below the plate-like element driven into each pile element respectively. The Moore patent contemplates a driving of the entire pile assembly after splicing. This is unlike the present invention where the second pile section is added after the first lowermost pile section is already driven to its final position.

A "Composite Pile and Method of Manufacture" is the subject of U.S. Pat. No. 4,252,473 issued to Albert M. Thomas, et al. The composite section includes a wooden section and a helically corrugated shell secured to the wooden section by a transition fitting. The corrugated steel carries a splice element that connects with the timber pile section. After driving, a liquid slurry of unhardened concrete can be added to the bore of the corrugated shell. Thus, the shell acts as a form for the concrete. A composite concrete and timber pile is the subject of U.S. Pat. No. 1,471,124 entitled "Means of Connecting Ferro or Reinforced Concrete Piles to Wooden Piles." "Composite Piles and Joiners Therefor" is the subject of U.S. Pat. No. 2,912,829 issued to W. H. Cobi. The Cobi patent shows a composite concrete and timber pile with a splice element therefor.

A "Method and Apparatus for Splicing Replacement Pile Sections to a Pile Stub" is the subject of U.S. Pat. No. 3,720,068 issued to E. R. DeRosa. That patent, however, deals with metal pile sections which are repaired with another metal pile section.

A splice element for two wooden utility poles, for example, is provided in U.S. Pat. No. 4,032,244. The extension would be attached to the flatten top of an existing pole. A projecting center shaft extends for the bracket to be received within mating center bores provided in the utility pole, a wooden extension pole or both. Threaded fasteners and metal straps complete the interconnection between the existing pole and the extension pole.

A "Pile Coupling and a Method of Pile Driving" is seen in U.S. Pat. No. 3,762,173 issued to Richard Marsh. The patent discloses a means for coupling sections of pile and a method of driving pile utilizing a thin-wall coposite pile section. The coupling comprises a thin-wall sleeve with a telescoping thick-wall ring or collar mechanically anchored within the sleeve. Taps intergrally formed in the collar, or the entire collar itself, are expanded within the sleeve to form correspondingly anchor pots in the sleeve thereby mechanically interlocking the collar and sleeve. The coupling is adpated for use in coupling successive sections of thick-wall tubular pile or in coupling thin-wall tubular composite pile or thick-wall tubular pile. Use of the thin-wall tubular composite pile enables employment of a method for driving which eliminates the necessity for retaining a succeeding thick-wall tubular pile after the initial one is driven home.

U.S. Pat. No. 3,003,323 issued to A. R. Holt entitled "Composite Pile Connector" shows a connector for use with a lower second of wood and an upper section of metallic pipe as part of a composite pile assembly. The connector includes a metallic ring having two plates disposed as chords within the ring, each chordal plate meeting at one end with the other so as to form the apex of a V with one leg on each side of the center of the ring. The plates are welded to the ring and the plates are of a length greater than the radius of the rings. The plates serve to displace the wood of a wood pile so as to wedge it tightly within the ring. This is unlike the present invention which uses a precast, hardened reinforced concrete pile as the upper pile section and joins that section to a lowermost timber pile section as part of a composite pile structure. The present invention improves upon the prior art method because the relatively brittle concrete pile section need not be driven at all.

Daigle et al., U.S. Pat. No. 4,547,096 entitled "Alignment Of Tubular Piles For Joinder," provides a method of alignment for two tubular piles. The aligner extends from one end of the tubular pile for insertion into the other tubular pile. One or more shim members are disposed between and in engagement with the outer surface of the aligner extended portion and the inner surface of the outer tubular pile when the extended portion is inserted therein for maintaining the two piles in alignment for joinder. This patent differs from the present invention because it does not contemplate the joining of a reinforced concrete and timber pile as part of a composite section.

Applicant also is the patentee of a prior U.S. Pat. No. 4,431,347 issued Feb. 14, 1984, and entitled "Composite Timber Pile System." In that prior Gillen patent, a method of driving composite timber pile sections provides a pair of timber pile sections, the first of which is driven into the earth a distance leaving the butt of the pile exposed. A splice element is embedded into the remaining pile section and leveling material is added to the top of the first pile section.

Applicant's prior U.S. Pat. No. 4,525,102 entitled "Timber Pile Connection System" provides a method of driving composite timber pile sections which provides a pair of timber pile sections, the first of which is driven into the earth a distance leaving the butt of the pile exposed. A splice element is embedded into the remaining pile section and leveling material is added to the top of the first pile section. Upon assembly and during driving, the leveling material is laterally confined with the splice element while the respective mating surfaces of the two pile sections confine the leveling material vertically with the leveling material thus transferring compressive forces between the two pile sections. The splice element is a cylindrical element having a hollow bore which during operation contains the leveling material. An initially displaceable but later setting, non-displaceable material such as motar (a mixture of cement, sand and water) could be used as a leveling material. The prior Gillen patent differs from the present invention in that it contemplates a driving of the composite pile section. Further, the first timber pile section is driven a distance downwardly, but leaving the butt portion of the pile exposed so that the splice element and leveling material can be added. This is unlike the present invention wherein the lowermost pile section is driven well below the earth's surface, and in fact a distance substantially equal to the length of the second pile section which is of reinforced concrete rather than timber.

A method of driving composite piles is seen in the Ingalls U.S. Pat. No. 4,102,141. In that patent, a composite pile structure is formed from a lower wooden section and an upper tubular metal section which is connected to the wood member and then filled with concrete. The wooden section is first started into the ground a desired distance and the metal section is then supported by the upper end of the wooden member. A mandrel member is located in driving engagement with the upper end of the metal section and the lower end of the mandrel is supported in spaced relation to the wooden member. Initial hammer energy of limited intensity is applied to drive the metal section into the wooden member until the bottom of the mandrel comes into contact with the top of the wooden member. Thereafter, hammer energy of greater intensity is applied to the connected sections and concentrated against the surface of the wooden member enclosed by the embedded metal section. The method contemplates liquid slurried concrete to be added to the metal section after the composite pile is driven to the desired depth. This is unlike the present invention wherein a precast, hardened reinforced concrete pile section is connected to the lowermost timber pile section after the lowermost timber pile section is driven fully to its elevational position, usually well below the surface.

SUMMARY OF THE INVENTION

The present invention involves a method for installing a composite pile structure of a timber pile section and a precast reinforced concrete pile section. The method includes the driving of the timber pile section first into the earth a distance well below the earth's surface, substantially equal to the length of the reinforced concrete pile section. A tubular sleeve with a hollow bore is used during driving of the timber pile section to prevent soil from entering the area vertically above the timber pile section. A precast, reinforced concrete pile is placed in the bore of the sleeve. The bottom of the concrete pile carries a connector which is then driven into the timber pile so that the two pile sections are connected. The tubular sleeve is then removed so that soil encroachment can laterally support the reinforced concrete pile section at a generally vertical position. The timber and concrete pile sections are joined preferably by the application of light pressure to the top of the concrete pile section which is sufficient to force the connector into the timber pile section. The connector can carry a mass of displaceable leveling material which enters the bore with the reinforced concrete pile, preferably connected to the connecting splice portion. The reinforced concrete pile is preferably a fully set concrete casting. The timber pile section and the sleeve are both driven simultaneously with an elongated cylindrical mandrel having a diameter substantially equal to the diameter of the precast reinforced concrete pile and of a diameter slightly smaller than the diameter of the bore of the sleeve. Thus, the sleeve and the mandrel are concentrically positioned during driving of the timber pile section. The mandrel thus bears against the top of the tubular sleeve and against the top of the timber pile section during driving of the timber pile section. The leveling material is contained in a flexible container such as a plastic film or bag or the like and affixed to the bottom of the concrete pile section interiorly of the connector so that the bag can rupture, spreading the leveling material evenly as the timber and concrete pile sections are adjoined.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figure 1:
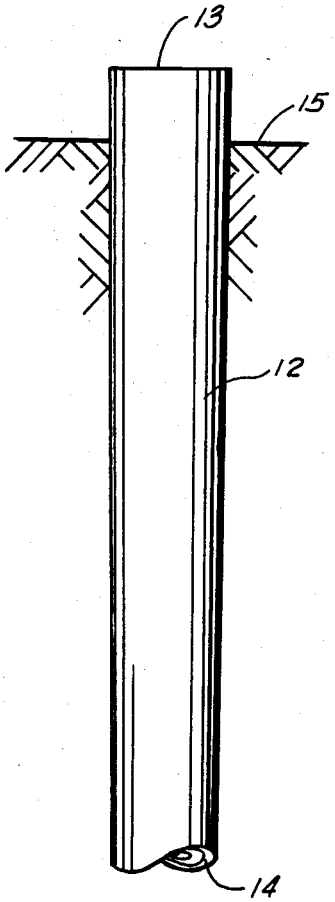
FIG. 1 is an elevational view of the method of the present invention illustrating the initial driving of a timber pile section a distance below the earth's surface.

FIGS. 1–6 illustrate the method of the present invention. In FIG. 1, there can be seen a timber pile section, typically an untreated or treated timber pile section 12, having an uppermost or butt end portion 13 and a lowermost tip portion 14. In FIG. 1, the pile section 12 has been driven until the butt is substantially adjacent the ground surface indicated as 15 in the drawing.

Figure 2:
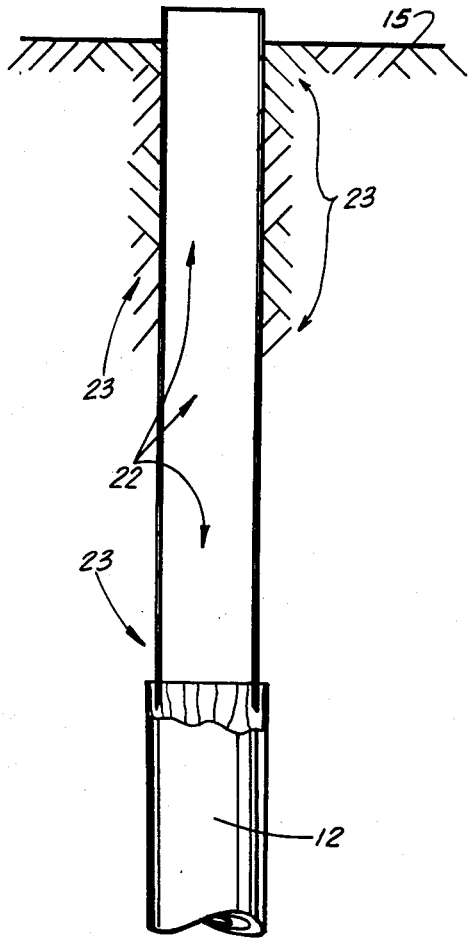
FIG. 2 is an elevational view of the method of the present invention illustrating the initial step of driving the timber pile section to a position well below the earth's surface.
Figure 3:
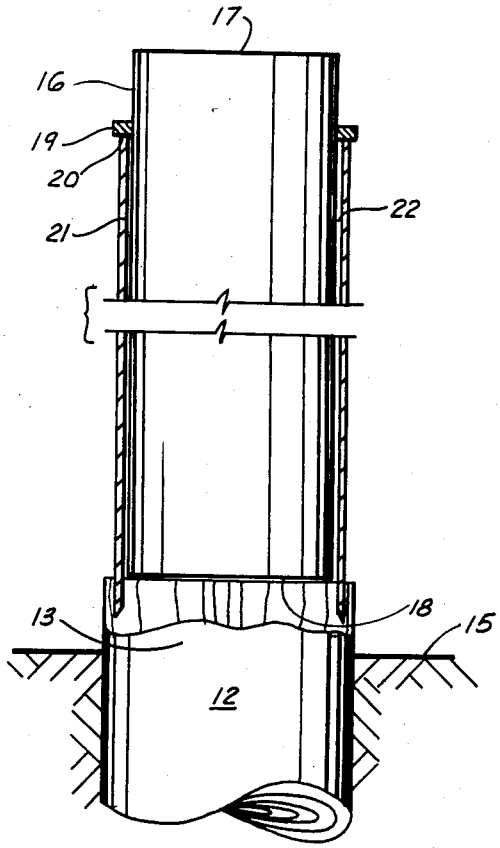
FIG. 3 is a fragmentary view illustrating the method of the present invention and particularly the initial step of joining the untreated timber pile section with the hollow metal sleeve section.
Figure 7:
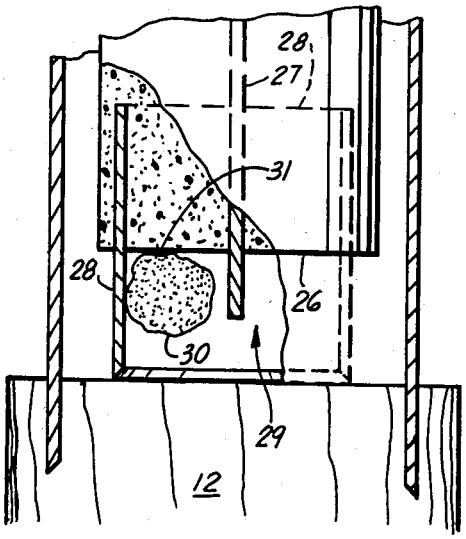
FIG. 7 is an enlarged view of the joining means shown in FIG. 4.

In FIGS. 2–3, the untreated timber pile section is driven a distance well below the ground surface 15 using cylindrical mandrel 16 having an uppermost portion 17 and a lowermost portion 18 which abuts the butt or uppermost end 13 of timber pile 12. Mandrel 16 can be a solid metal cylinder, but preferably includes an uppermost peripheral annular ring 19 which in operation engages the upper edge 20 of cylindrical shell 21. Shell 21 has a hollow bore 22 which is occupied by mandrel 16 during the driving of timber pile section 12.

Figure 4:
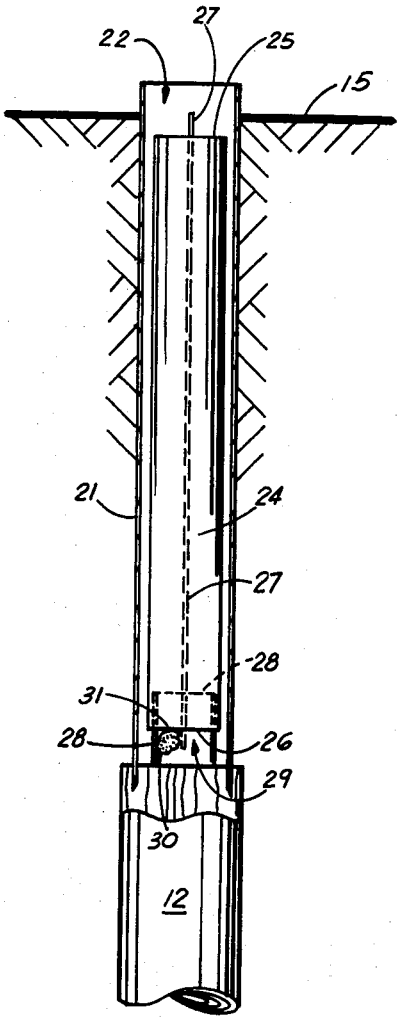
FIG. 4 is another elevational view of the method of the present invention illustrating the step of joining the precast hardened reinforced concrete section with the timber section after the timber section is in its elevational position.

In FIG. 4, the timber pile section 12 has been driven a distance well below the ground surface 15 and the mandrel 16 removed from bore 22 of sleeve 21. In this position, sleeve 21 functions to prevent the encroachment of the surrounding soil mass 23 into the area vertically above timber pile section 12.

In FIG. 4, the method illustrates the placement of reinforced concrete pile section 24 into the bore 22 of sleeve 21. Concrete pile section 24 includes upper 25 and lower 26 end portions and internal reinforcing steel 27 which can comprise one or more longitudinally running reinforcing bars and a plurality of transverse ties, for example.

The lowermost end portion 26 of concrete pile section 24 includes connector 28 which is partially embedded into the end 26 of concrete pile section 24. Connector 28 is preferably a cylindrical section which forms a rigid connection with the lowermost end portion 26 of concrete pile section 24.

Figure 5:
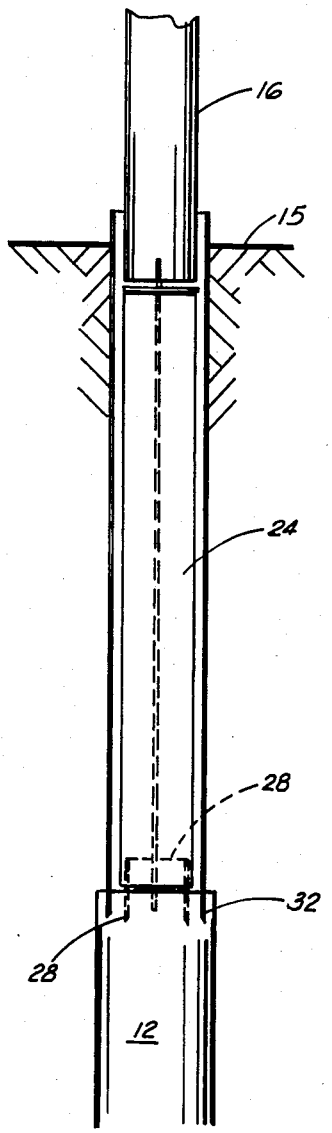
FIG. 5 is an elevational view illustrating the method of the present invention and particularly the joining of the reinforced concrete and timber pile sections.
Figure 6:
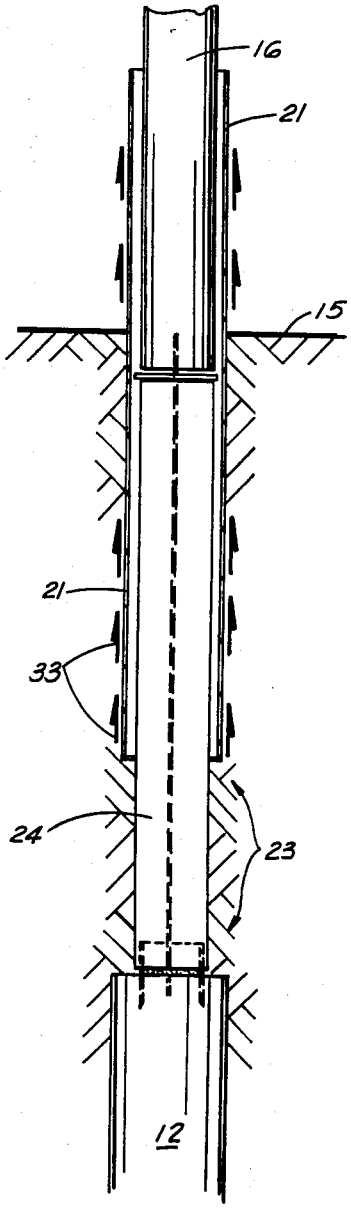
FIG. 6 is an elevational view of the method of the present invention illustrating removal of the metallic sleeve after placement of the reinforced concrete pile section upon the timber pile section.

In FIG. 4, the connector 28 includes a hollow socket or end portion 29 that defines a recess occupied by leveling material 30 which is preferably in the form of a mass of sand or like grannular material contained within a plastic bag 31. The bag can be connected to the connector wall directly or supported by reinforcing steel member 27 which might extend beyond the lowermost portion 26 of pile section 24. When concrete pile section 24 is placed in the position shown in FIG. 4, light pressure is applied using mandrel 16 so as to force the pile section 24 downwardly until the exposed portion 32 of connector 38 is embedded in timber pile section 12 as illustrated in figure 5. The leveling material 30 is thus trapped between pile sections 12 and 24 and confined laterlly by connector 28 thus forming a load transfer interface between the pile sections 12 and 24.

From the above, one skilled in the art will recognize that no driving is required upon pile section 24 thus preventing any possible damage to same. Rather, only light pressure is needed, that is pressure sufficient to drive the lowermost or exposed portion 32 of connector 38 into timber pile section 12. Thereafter, sleeve 21 can be removed using a dragline, crane, or winch as illustrated by the arrows 33 in FIG. 6. Normally, the drive hammer is placed on the mandrel when the sleeve is removed. Such drive hammers weight about 12,000 lbs. After removal of the sleeve 21, the surrounding soil mass 23 can laterally support pile section 24.

The mandrel 16 and sleeve 21 can be reused over and over making this an advantage over prior art systems which leave a steel sleeve in position by connecting the sleeve permanently to an underlying pile section and then filling the sleeve with concrete. By removing the steel sleeve and by using a precast, hardened concrete pile section, an economical composite pile construction is provided. Further, because the timber pile section is driven well below the earth's surface to its final resting position prior to placement of the reinforced concrete pile section, the reinforced concrete pile section is not subjected to any of the driving stresses which normally are transmitted to pile sections that are composite and driven.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for installing a composite pile of a timber pile section and a precast, reinforced concrete pile section comprising the steps of:

a. simultaneously driving a timber pile section and a tubular sleeve positioned vertically above the sleeve and connected thereto into the earth so that the timber pile section is a distance well below the earth's surface, a distance substantially equal to the length of the reinforced concrete pile section;

b. using a tubular sleeve with a hollow bore during the simultaneous driving of the timber pile section and the tubular sleeve to prevent soil from entering the area vertically above the timber pile;

c. placing a precast, reinforced concrete pile in the bore of the sleeve;

d. joining the bottom of the concrete pile and the top of the timber pile with a connector that is embedded partially in the lower end of the concrete pile prior to joining;

e. removing the tubular sleeve so that soil encroachment can laterally support the reinforced concrete pile section.

2. The method of claim 1 wherein in step "d" the timber and the concrete pile sections are joined by the application of light pressure to the top of the concrete pile section which is sufficient to force the connector into the timber pile section.

3. The method of claim 1 wherien in step "d" the connector carries a mass of displaceable leveling material which enters the bore with the reinforced concrete piile.

4. The method of claim 1 wherein step "c" the precast, reinforced concrete pile is a fully set concrete casting.

5. The method of claim 1 wherein in step "a" the timber pile is driven with an elongated mandrel having a diameter substantially equal to the diameter of the precast, reinforced concrete pile.

6. The method of claim 5 wherein in step "a" the sleeve and mandrel are concentrically positioned during driving of the timber pile section.

7. The method of claim 6 wherein in step "a" the mandrel bears against the top of the tubular sleeve and the top of the timber pile section during driving of the timber pile section.

8. The method of claim 3 wherein in step "d," the leveling material is contained in a flexible container affixed to the bottom of the concrete pile section.

* * * * *